US010957257B2

(12) United States Patent
Ma

(10) Patent No.: US 10,957,257 B2
(45) Date of Patent: Mar. 23, 2021

(54) PIXEL CIRCUIT, DRIVING METHOD THEREOF AND DISPLAY PANEL

(71) Applicants: BOE TECHNOLOGY GROUP CO., LTD., Beijing (CN); CHENGDU BOE OPTOELECTRONICS TECHNOLOGY CO., LTD., Sichuan (CN)

(72) Inventor: Guoqiang Ma, Beijing (CN)

(73) Assignees: BOE TECHNOLOGY GROUP CO., LTD., Beijing (CN); CHENGDU BOE OPTOELECTRONICS TECHNOLOGY CO., LTD., Sichuan (CN)

( * ) Notice: Subject to any disclaimer, the term of this patent is extended or adjusted under 35 U.S.C. 154(b) by 242 days.

(21) Appl. No.: 16/300,636

(22) PCT Filed: Apr. 4, 2018

(86) PCT No.: PCT/CN2018/081838
§ 371 (c)(1),
(2) Date: Nov. 12, 2018

(87) PCT Pub. No.: WO2019/001067
PCT Pub. Date: Jan. 3, 2019

(65) Prior Publication Data

US 2020/0320934 A1 Oct. 8, 2020

(30) Foreign Application Priority Data

Jun. 29, 2017 (CN) ..... 2017 1 0515661

(51) Int. Cl.
*G06F 3/044* (2006.01)
*G09G 3/3258* (2016.01)

(52) U.S. Cl.
CPC ..... *G09G 3/3258* (2013.01); *G09G 2310/061* (2013.01); *G09G 2320/0233* (2013.01)

(58) Field of Classification Search
None
See application file for complete search history.

(56) References Cited

U.S. PATENT DOCUMENTS

2010/0033477 A1* 2/2010 Yamashita ..... G09G 3/3233 345/215
2011/0227903 A1 9/2011 Choi
(Continued)

FOREIGN PATENT DOCUMENTS

CN 101996579 A 3/2011
CN 102956192 A 3/2013
(Continued)

OTHER PUBLICATIONS

Search Report and Written Opinion for International Application No. PCT/CN2018/081838 dated Jun. 27, 2018.
(Continued)

*Primary Examiner* — Carl Adams
(74) *Attorney, Agent, or Firm* — Calfee, Halter & Griswold LLP

(57) ABSTRACT

A pixel circuit, a driving method thereof and a display panel are provided. The pixel circuit includes a reset sub-circuit, a compensation sub-circuit, a driving sub-circuit, a control sub-circuit, a data signal writing sub-circuit, a power input sub-circuit and a light emitting device. The compensation sub-circuit may store a compensation voltage for the gate of the driving transistor in the driving sub-circuit, which can alleviate or eliminate the influence of the threshold voltage of the driving transistor on the driving current of the light
(Continued)

emitting device, thereby improving the uniformity in brightness of the light emitting device, which enhances the display quality of the display panel.

17 Claims, 4 Drawing Sheets

(56) References Cited

U.S. PATENT DOCUMENTS

| | | | | |
|---|---|---|---|---|
| 2013/0043802 | A1 | 2/2013 | Han et al. | |
| 2015/0378470 | A1* | 12/2015 | Yang | G06F 3/044 345/174 |
| 2016/0358546 | A1 | 12/2016 | Ma | |

FOREIGN PATENT DOCUMENTS

| | | | |
|---|---|---|---|
| CN | 102982766 | A | 3/2013 |
| CN | 103280182 | A | 9/2013 |
| CN | 104680976 | A | 6/2015 |
| CN | 104809989 | A | 7/2015 |
| CN | 104867442 | A | 8/2015 |
| CN | 204680360 | U | 9/2015 |
| CN | 107103882 | A | 8/2017 |
| KR | 20060038847 | A | 5/2006 |

OTHER PUBLICATIONS

First Office Action for Chinese Patent Application No. 201710515661.1 dated Oct. 22, 2018.

Second Office Action for Chinese Patent Application No. 201710515661.1 dated Mar. 7, 2019.

Third Office Action for Chinese Patent Application No. 201710515661.1 dated Aug. 20, 2019.

* cited by examiner

PIXEL CIRCUIT, DRIVING METHOD THEREOF AND DISPLAY PANEL

RELATED APPLICATION

The present application is the U.S. national phase entry of PCT/CN2018/081838, with an international filling date of Apr. 4, 2018, which claims the benefit of Chinese Patent Application No. 201710515661.1, filed on Jun. 29, 2017, the entire disclosures of which are incorporated herein by reference.

TECHNICAL FIELD

The present disclosure relates to the field of display technologies, and especially to a pixel circuit, a driving method thereof, and a display panel.

BACKGROUND

With the progress in display technologies, the amount active matrix organic light emitting diode (AMOLED) display panels coming into the market has increased. The AMOLED display panel has advantages such as low energy consumption, low production cost, self-illumination, wide viewing angle, fast response and the like compared to a traditional thin film transistor liquid crystal display (TFT LCD) panel. At present, it has gradually replaced the traditional LCD display screen in the display fields of mobile phones, PDAs, digital cameras, etc. Unlike TFT LCDs, which use a stable voltage to control brightness, AMOLEDs are current driven and require a stable current to control luminescence.

The brightness of an OLED is quite sensitive to changes in its driving current, and it is difficult to make completely identical driving transistors for driving the light emitting device to emit light in the manufacturing process, that is, it is difficult to enable the driving transistors in respective OLED pixel circuits to have consistent threshold voltages. In addition, factors such as process procedure, device aging, and changes in temperature during operation will exacerbate the non-uniformity between the threshold voltages of the driving transistors in the respective pixel circuits. This results in a large difference between currents flowing through the OLEDs in respective pixels, so that the display brightness is uneven, which in turn affects the display effect of the entire image.

SUMMARY

A pixel circuit provided by an embodiment of the present disclosure comprises a reset sub-circuit, a compensation sub-circuit, a driving sub-circuit, a control sub-circuit, a data signal writing sub-circuit, a power input sub-circuit, and a light emitting device. The power input sub-circuit, the driving sub-circuit, the control sub-circuit, and the light emitting device are sequentially connected in series, one terminal of the light emitting device is connected to a reference potential terminal, the other terminal of the light emitting device is connected to the control sub-circuit through a first node, the reset sub-circuit is connected in parallel with the light emitting device, and the driving sub-circuit comprises a driving transistor. A first terminal of the reset sub-circuit is connected to the first node between the light emitting device and the control sub-circuit, a second terminal of the reset sub-circuit is connected to the reference potential terminal, a control terminal of the reset sub-circuit is used for receiving a reset signal, and the reset sub-circuit is used for outputting a reference potential signal of the reference potential terminal to the first node under control of the reset signal; a first terminal of the compensation sub-circuit is connected to the first node, a second terminal thereof is connected to a second node between the power input sub-circuit and the driving sub-circuit, a third terminal thereof is connected to a gate of the driving transistor of the driving sub-circuit, a control terminal thereof is used for receiving a first control signal, and the compensation sub-circuit is used for storing a compensation voltage for the gate of the driving transistor of the driving sub-circuit under control of the first control signal; the driving sub-circuit is connected to the control sub-circuit via a third node, and is used for bringing the second node into connection with the third node under control of an output signal of the third terminal of the compensation sub-circuit; a control terminal of the control sub-circuit is used for receiving a second control signal, and the control sub-circuit is used for bringing the third node into connection with the first node under control of the second control signal; a control terminal of the data signal writing sub-circuit is used for receiving the first control signal, a first terminal of the data signal writing sub-circuit is used for receiving a data signal, a second terminal of the data signal writing sub-circuit is connected to the third node, and the data signal writing sub-circuit is used for writing the data signal into the third node under control of the first control signal; the power input sub-circuit receives a power signal and the second control signal for outputting the power signal to the second node under control of the second control signal.

In some embodiments, a first terminal of the driving transistor is connected to the second node, and a second terminal is connected to the third node.

In some embodiments, the power input sub-circuit comprises a second switching transistor; a gate of the second switching transistor being used for receiving the second control signal, a first terminal thereof being used for receiving the power signal, and a second terminal thereof being connected to the second node.

In some embodiments, the control sub-circuit comprises a third switching transistor; a gate of the third switching transistor being used for receiving the second control signal, a first terminal thereof being connected to the third node, and a second terminal thereof being connected to the first node.

In some embodiments, the data signal writing sub-circuit comprises a fourth switching transistor; a gate of the fourth switching transistor being used for receiving the first control signal, a first terminal thereof being used for inputting the data signal, and a second terminal thereof being connected to the third node.

In some embodiments, the compensation sub-circuit comprises a fifth switching transistor and a capacitor; wherein a gate of the fifth switching transistor is used for receiving the first control signal, a first terminal thereof is connected to the second node, and a second terminal thereof is connected to one terminal of the capacitor and the gate of the driving transistor, respectively; the other terminal of the capacitor is connected to the first node.

In some embodiments, the reset sub-circuit comprises a sixth switching transistor; a gate of the sixth switching transistor being used for receiving a reset signal, a first terminal thereof being connected to the reference potential terminal, and a second terminal thereof being connected to the first node.

In some embodiments, the compensation voltage is a sum of a data voltage and a threshold voltage of the driving transistor.

Another embodiment of the present disclosure provides a driving method for the pixel circuit described in any of the foregoing embodiments, the driving method comprising:

connecting, by the reset sub-circuit, the first node to the reference potential terminal under control of the reset signal; writing, by the data signal writing sub-circuit, the data signal into the third node under control of the first control signal, and storing, by the compensation sub-circuit, a compensation voltage for the gate of the driving transistor of the driving sub-circuit under control of the first control signal; outputting, by the power input sub-circuit, the power signal to the second node under control of the second control signal, bringing, by the driving sub-circuit, the second node into connection with the third node under control of the compensation voltage, and bringing, by the control sub-circuit, the third node into connection with the first node under control of the second control signal.

A further embodiment of the present disclosure provides a display panel which may comprise the pixel circuit described in any of the foregoing embodiments.

A pixel circuit provided by yet another embodiment of the present disclosure comprises: a driving transistor, a second switching transistor, a third switching transistor, a fourth switching transistor, a fifth switching transistor, a sixth switching transistor, a capacitor, and a light emitting device. A gate of the driving transistor is connected to one terminal of the capacitor and a second terminal of the fifth switching transistor, respectively, a first terminal of the driving transistor is connected to a second node, and a second terminal of the driving transistor is connected to a third node; a gate of the second switching transistor is used for receiving a second control signal, a first terminal thereof is used for receiving a power signal, and a second terminal thereof is connected to the second node; a gate of the third switching transistor is used for receiving the second control signal, a first terminal thereof is connected to the third node, and a second terminal thereof is connected to a first node; a gate of the fourth switching transistor is used for receiving a first control signal, a first terminal thereof is used for receiving a data signal, and a second terminal thereof is connected to the third node; a gate of the fifth switching transistor is used for receiving the first control signal, and a first terminal thereof is connected to the second node; the other terminal of the capacitor is connected to the first node; a gate of the sixth switching transistor is used for receiving a reset signal, a first terminal thereof is connected to a reference potential signal terminal, and a second terminal thereof is connected to the first node; a first terminal of the light emitting device is connected to the first node, and a second terminal thereof is connected to the reference potential signal terminal.

In some embodiments, the driving transistor is an N-type transistor, and the second switching transistor, the third switching transistor, the fourth switching transistor, the fifth switching transistor, and the sixth switching transistor are all P-type transistors.

DETAILED DESCRIPTION

Next, specific embodiments of the pixel circuit, the driving method thereof and the display panel provided by embodiments of the disclosure will be described in detail below with reference to the accompanying drawings.

Figure 1:
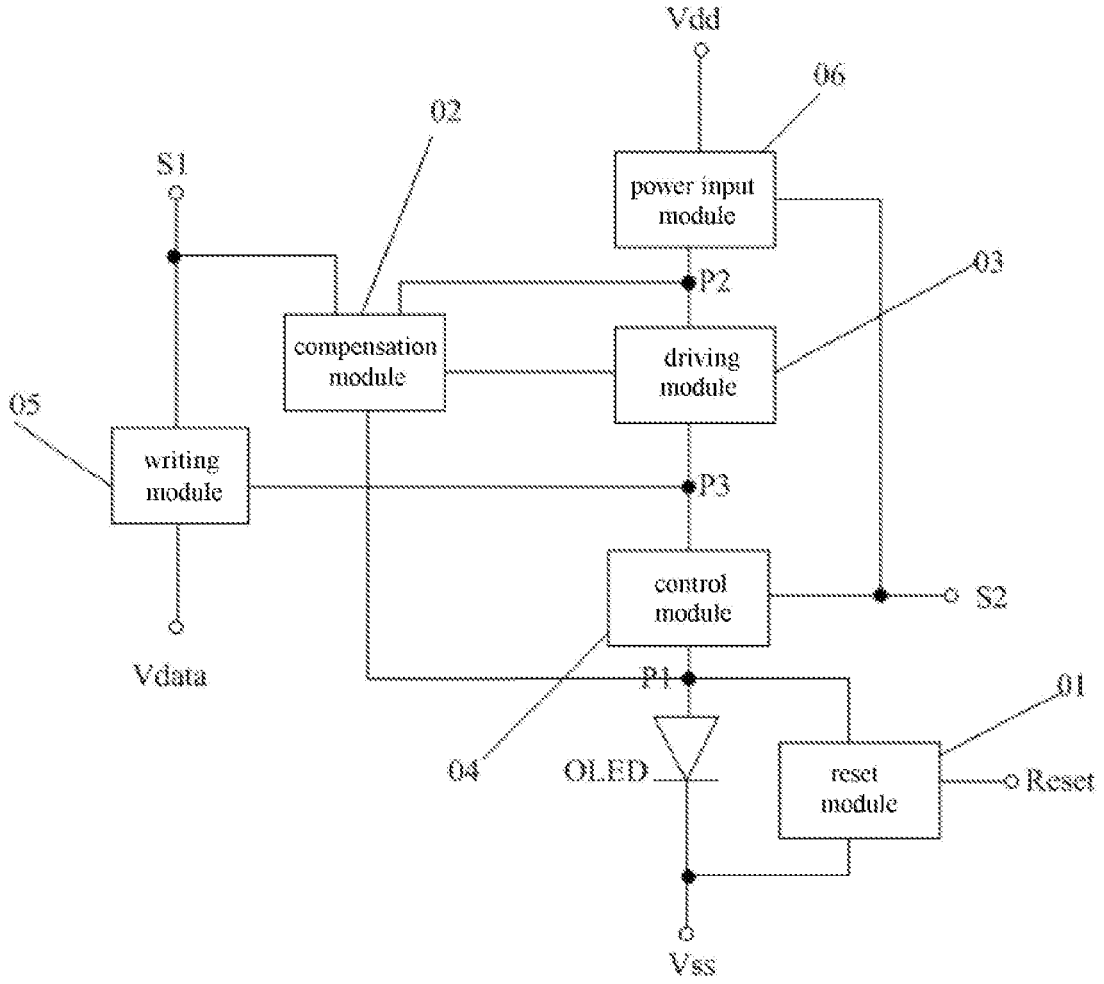
FIG. 1 schematically illustrates a structural block diagram of a pixel circuit provided by an embodiment of the present disclosure.

An embodiment of the disclosure provides a pixel circuit, as shown in FIG. 1, which may comprise: a reset sub-circuit 01, a compensation sub-circuit 02, a driving sub-circuit 03, a control sub-circuit 04, a data signal writing sub-circuit 05, a power input sub-circuit 06, and a light emitting device OLED. The power input sub-circuit, the driving sub-circuit, the control sub-circuit and the light emitting device are sequentially connected in series, one terminal of the light emitting device is connected to a reference potential terminal, the other terminal of the light emitting device is connected to the control sub-circuit through a first node, the reset sub-circuit is connected in parallel with the light emitting device, and the driving sub-circuit comprises a driving transistor.

A terminal of the reset sub-circuit 01 is connected to a reference potential terminal Vss, another terminal of the reset sub-circuit is connected to the first node P1, and a control terminal reset thereof is used for receiving a reset signal. The reset sub-circuit 01 is used for outputting a reference signal of the reference potential terminal to the first node P1 under control of the reset signal. In an embodiment, the reference potential signal is a low level signal.

A first terminal of the compensation sub-circuit 02 is connected to the first node P1, a second terminal thereof is connected to a second node P2, a control terminal thereof is used for receiving a first control signal S1, and a third terminal thereof is connected to a gate of the driving transistor in the driving sub-circuit 03. The compensation sub-circuit 02 is used for providing a compensation voltage to the gate of the driving transistor of the driving sub-circuit 03 under the control of the first control signal S1.

A first terminal of the driving sub-circuit 03 is connected to the second node P2, and a second terminal thereof is connected to a third node P3. The driving sub-circuit 03 is used for bringing the second node P2 into connection with the third node P3 under the control of an output signal of the third terminal of the compensation sub-circuit.

A control terminal of the control sub-circuit 04 is used for receiving a second control signal S2, a first terminal thereof is connected to the third node P3, and a second terminal thereof is connected to the first node P1. The control sub-circuit 04 is used for bringing the third node P3 into connection with the first node P1 under the control of the second control signal S2 so as to drive the light emitting device OLED to emit light.

A control terminal of the data signal writing sub-circuit 05 is used for receiving the first control signal S1, a first terminal thereof is used for receiving a data signal Vdata, a second terminal thereof is connected to the third node P3. The data signal writing sub-circuit 05 is used for writing the data signal Vdata into the third node P3 under the control of the first control signal S1.

The power input sub-circuit 06 receives a power signal Vdd and the second control signal S2, and an output terminal of the power input sub-circuit 06 is connected to the second node P2. The power input sub-circuit 06 is used for outputting the power signal Vdd to the second node P2 under the control of the second control signal S2.

For the above-described pixel circuit provided by the embodiment of the disclosure, the compensation sub-circuit may provide a compensation voltage to the gate voltage for the driving transistor in the driving sub-circuit when in operation, so as to eliminate or alleviate the influence of the threshold voltage of the driving transistor on the driving current of the OLED light emitting device, so that the uniformity in brightness of the light emitting device is improved, thereby enhancing the image display quality of the display panel.

Figure 2A:
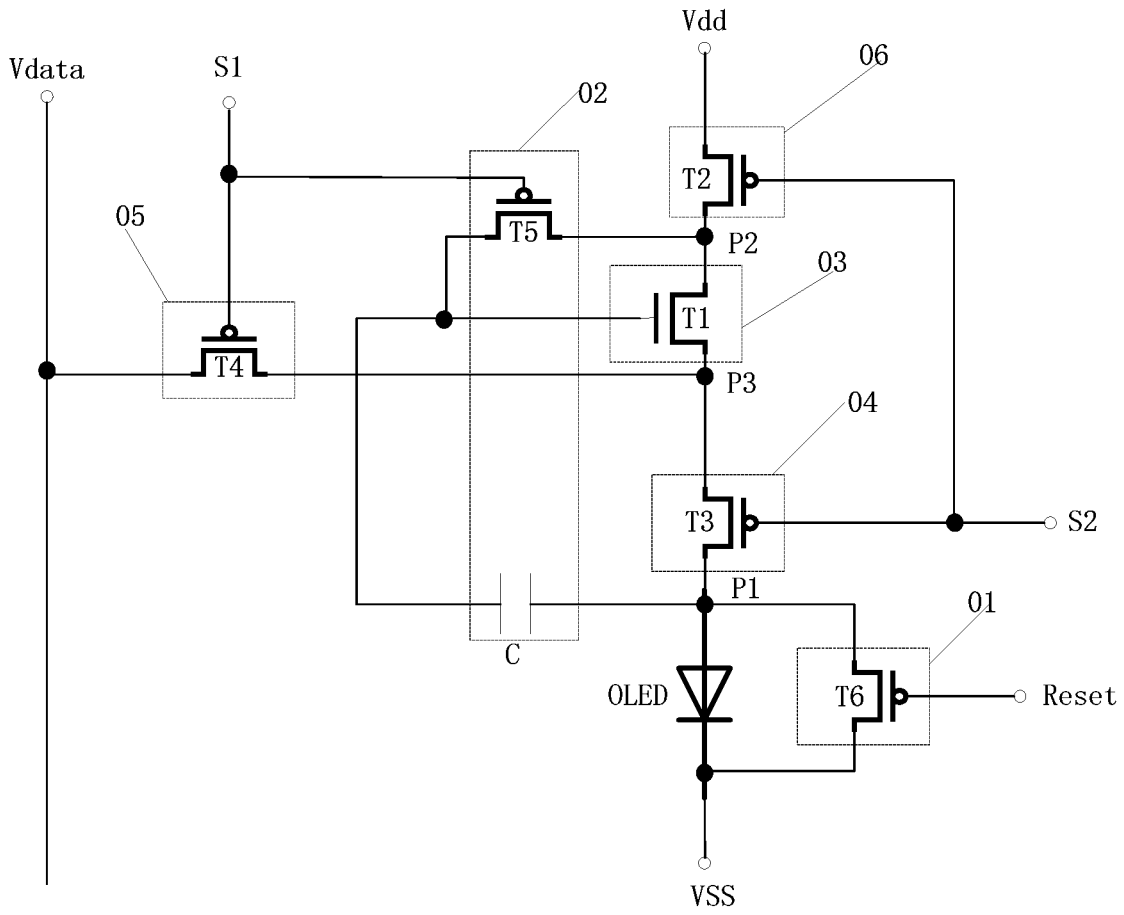
FIG. 2A is a structural diagram of a pixel circuit provided by an embodiment of the present disclosure.

FIG. 2A illustrates an example of the pixel circuit shown in FIG. 1. As shown in FIG. 2A, the driving sub-circuit 03 may comprise a driving transistor T1. A gate of the driving transistor T1 is connected to the third terminal of the compensation sub-circuit 02, a first terminal thereof is connected to the second node P2, and a second terminal thereof is connected to the third node P3. Specifically, the driving transistor can be turned on under the control of the output signal of the third terminal of the compensation sub-circuit, thereby bringing the second node into connection with the third node.

In the above-described pixel circuit provided by the embodiment of the disclosure, as shown in FIG. 2A, the power input sub-circuit 06 may comprise a second switching transistor T2. A gate of the second switching transistor T2 is used for receiving the second control signal S2, a first terminal thereof is used for receiving the power signal Vdd, and a second terminal thereof is connected to the second node P2. Specifically, the second switching transistor can be turned on under the control of the second control signal, and the turned-on second switching transistor can output the power signal to the second node.

In the above-described pixel circuit provided by an embodiment of the disclosure, as shown in FIG. 2A, the control sub-circuit 04 may comprise a third switching transistor T3. A gate of the third switching transistor T3 is used for receiving the second control signal S2, a first terminal thereof is connected to the third node P3, and a second terminal thereof is connected to the first node P1. Specifically, the third switching transistor can be turned on under the control of the second control signal, and the turned-on third switching transistor can bring the first node into connection with the third node.

In the pixel circuit provided by an embodiment of the present disclosure, as shown in FIG. 2A, the data signal writing sub-circuit 05 may comprise a fourth switching transistor T4. A gate of the fourth switching transistor T4 is used for inputting the first control signal S1, a first terminal thereof is used for inputting the data signal Vdata, and a second terminal thereof is connected to the third node P3. Specifically, the fourth switching transistor can be turned on under the control of the first control signal, and the turned-on fourth switching transistor can output the data signal to the third node.

In the pixel circuit provided by an embodiment of the disclosure, as shown in FIG. 2A, the compensation sub-circuit 02 may comprise a fifth switching transistor T5 and a capacitor C. A gate of the fifth switching transistor T5 is used for receiving the first control signal S1, a first terminal thereof is connected to the second node P2, and a second terminal thereof is connected to one terminal of the capacitor C and the gate of the driving transistor in the driving sub-circuit 03, respectively. The other terminal of the capacitor C is connected to the first node P1. Specifically, the fifth switching transistor can be turned on under the control of the first control signal, and the turned-on fifth switching transistor can bring the second node into connection with the gate of the driving transistor.

In the pixel circuit provided by an embodiment of the present disclosure, as shown in FIG. 2A, the reset sub-circuit 01 may comprise a sixth switching transistor T6. A gate of the sixth switching transistor T6 is used for receiving a reset signal, a first terminal thereof is used for receiving the reference potential signal Vss, and a second terminal thereof is connected to the first node P1. Specifically, the sixth switching transistor can be turned on under the control of the reset signal, and the turned-on sixth switching transistor can output the reference potential signal to the first node.

FIG. 2A shows the main elements of various sub-circuits in the pixel circuit, and those skilled in the art will appreciate that the various sub-circuits of the pixel circuit may also include elements not shown in FIG. 2A. However, in an embodiment, the various sub-circuits in the pixel circuit described in the foregoing embodiments may also be composed only of the elements described above. Therefore, in this embodiment, as shown in FIG. 2B, the pixel circuit comprises a driving transistor T1, switching transistors T2 to T6, a capacitor C, and a light emitting device OLED.

The gate of the driving transistor T1 is connected to one terminal of the capacitor C and the second terminal of the fifth switching transistor T5, respectively, and the first terminal and the second terminal of the driving transistor T1 are connected to the second node P2 and the third node P3 respectively. The gate of the second switching transistor T2 is used for receiving the second control signal S2, the first terminal thereof is used for receiving the power signal Vdd, and the second terminal thereof is connected to the second node P2. The gate of the third switching transistor T3 is used for receiving the second control signal S2, the first terminal thereof is connected to the third node P3, and the second terminal thereof is connected to the first node P1. The gate of the fourth switching transistor T4 is used for receiving the first control signal S1, the first terminal thereof is used for receiving the data signal Vdata, and the second terminal thereof is connected to the third node P3. The gate of the fifth switching transistor T5 is used for receiving the first control signal S1, and the first terminal thereof is connected to the second node P2. The other terminal of the capacitor C is connected to the first node P1. The gate of the sixth switching transistor T6 is used for receiving the reset signal, the first terminal thereof is used for receiving the reference potential signal Vss, and the second terminal thereof is connected to the first node P1. The anode of the light emitting device OLED is connected to the first node P1, and the cathode thereof is connected to a reference potential signal terminal. In the example shown in FIG. 2B, the driving transistor T1 is an N-type metal oxide semiconductor field effect transistor, and the switching transistors T2-T6 are P-type metal oxide semiconductor field effect transistors. In this example, the source of the driving transistor T1 is connected to the third node P3, and the drain thereof is connected to the second node P2.

Figure 2B:
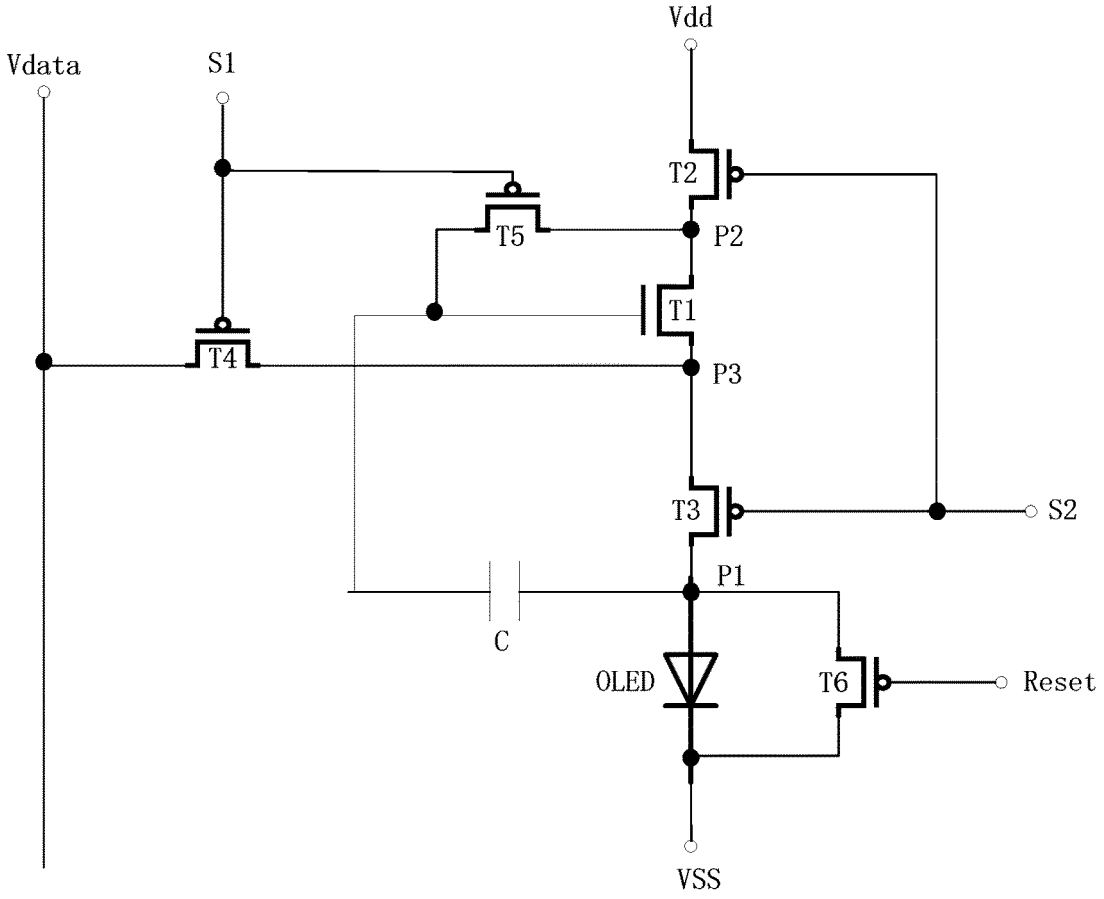
FIG. 2B is a structural diagram of a pixel circuit provided by an embodiment of the present disclosure.

For the pixel circuit provided by the embodiment shown in FIG. 2B, the driving current for driving the light emitting device OLED to emit light can be expressed as:

$$I=\tfrac{1}{2}K(Vgs-Vth)^2=\tfrac{1}{2}K(V\text{data}+Vo-Vss-Vdd)^2,$$

wherein, Vo is a voltage of the anode of the light emitting device OLED, K is a constant related to the parameters of the fabrication process for the driving transistor T1 and the geometric dimensions thereof, and Vgs is a voltage difference between the gate and the first terminal of the driving transistor. It can be seen from the above current calculation formula that, the driving current for driving the light emitting device OLED to emit light is independent of the threshold voltage Vth, so that the influence of changes in the threshold voltage on the brightness of the light emitting device can be eliminated. In addition, as the light emitting device ages, the voltage Vo of the anode of the light emitting device may gradually increase in operation, and the driving current I thereof increases accordingly, so that the problem regarding the decrease in brightness resulting from aging of the light emitting device OLED can be mitigated.

Figure 3:
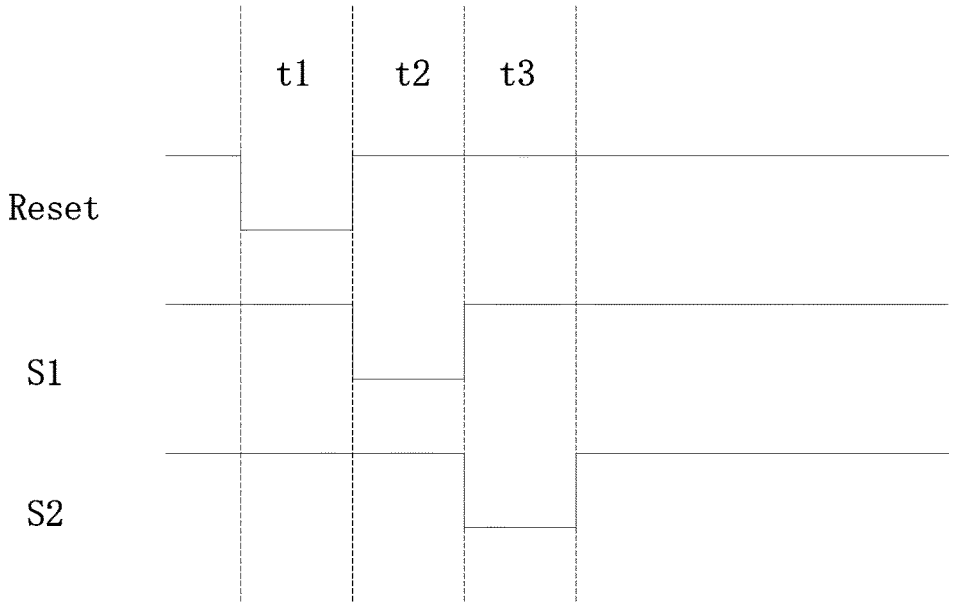
FIG. 3 is an exemplary operating timing diagram for the pixel circuit shown in FIG. 2B.

The driving transistor and the switching transistors mentioned in the above embodiments of the disclosure may be thin film transistors (TFTs) or metal oxide semiconductor field effect transistors (MOSs), which are not limited herein. During specific implementation, the first and second terminals of these transistors may be interchanged, which are not specifically distinguished. The operating process of the pixel circuit provided by an embodiment of the disclosure is to be described in detail below with reference to exemplary operating timing. FIG. 3 illustrates a signal timing diagram for the pixel circuit shown in FIG. 2B, in which three time periods t1 to t3 are shown. In the description below, a high level signal is indicated by "1" and a low level signal is indicated by "0".

In a phase t1, Reset=0, S1=1, and S2=1. Since Reset=0, the sixth switching transistor T6 is turned on, and the turned-on sixth switching transistor T6 outputs the reference potential signal Vss of low level to the first node P1, thereby resetting the first node P1, i.e., resetting the anode of the light emitting device OLED and one terminal of the capacitor C.

In a phase t2, Reset=1, S1=0, and S2=1. Since S1=0, the fourth switching transistor T4 and the fifth switching transistor T5 are turned on. The turned-on fourth switching transistor T4 outputs the data signal Vdata to the third node P3, and the turned-on fifth switching transistor T5 brings the second node P2 into connection with the gate of the driving transistor T1. At that time, the voltage between the source and the drain of the driving transistor T1 is approximately the threshold voltage Vth of the driving transistor T1. The data signal Vdata charges one terminal of the capacitor C through the driving transistor T1 and the fifth switching transistor T5 until the voltage at the terminal of the capacitor C is Vdata+Vth, so that the threshold voltage Vth is written into the capacitor C, thereby achieving compensation to the gate voltage of the driving transistor.

In a phase t3, Reset=1, S1=1, and S2=0. Since S2=0, the second switching transistor T2 and the third switching transistor T3 are turned on. The turned-on second switching transistor T2 outputs the power signal Vdd to the second node P2. The driving transistor T1 is turned on under the control of the voltage signal maintained by one terminal of the capacitor C which is connected to the gate of the driving transistor T1. The turned-on third switching transistor T3 brings the third node P3 into conduction with the first node P1, thereby driving the light emitting device OLED to emit light. At that time, the voltage difference between the gate and the source of the driving transistor T1 can be expressed as: Vgs=(Vdata+Vth)−(Vdd−Vo+Vss), and therefore, the driving current for driving the light emitting device OLED to emit light is:

$$I=\tfrac{1}{2}K(Vgs-Vth)^2=\tfrac{1}{2}-K(V\text{data}+Vo-Vss-Vdd)^2.$$

It can be seen from the above current calculation formula that, for the pixel circuit provided by the embodiment of the disclosure, the driving current for driving the light emitting device OLED to emit light is independent of the threshold voltage Vth, so the influence of changes in the threshold voltage on the brightness of the light emitting device can be eliminated. Meanwhile, as the voltage Vo of the anode of the light emitting device increases due to aging of the light emitting device, the driving current I thereof increases accordingly, so that the problem regarding the decrease in brightness resulting from aging of the light emitting device OLED can be alleviated.

Figure 4:
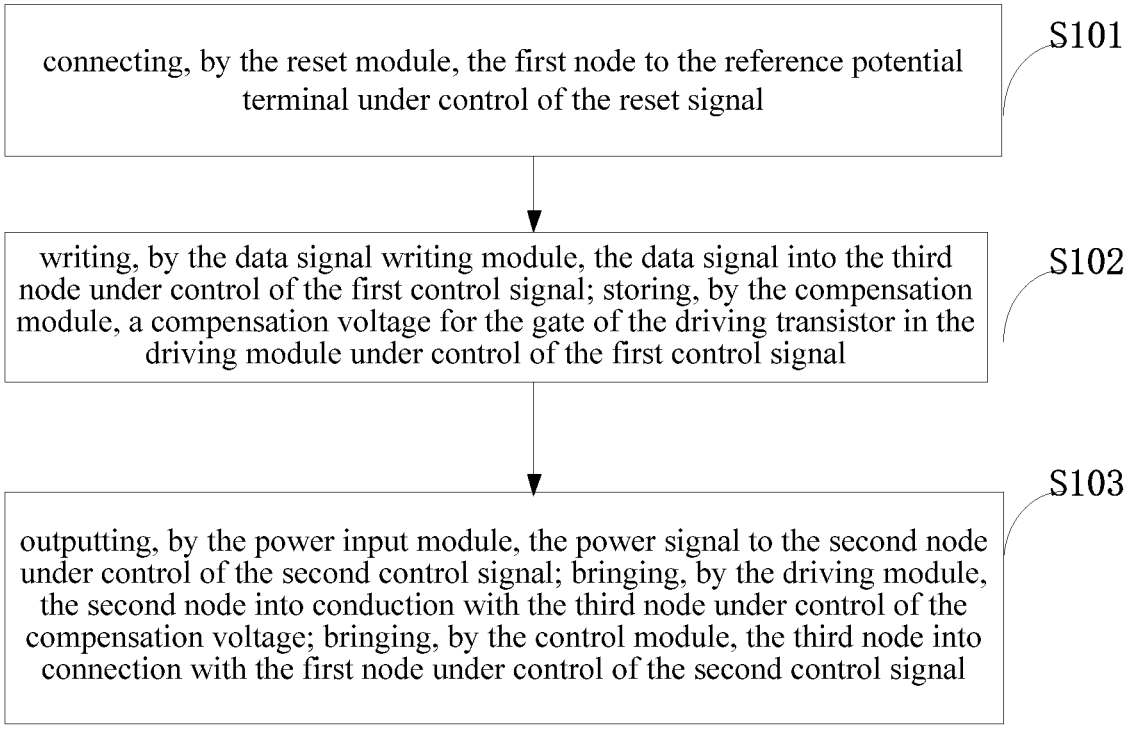
FIG. 4 is a flowchart of a driving method for a pixel circuit provided by an embodiment of the present disclosure.

An embodiment of the disclosure provides a driving method for the pixel circuit provided by the foregoing embodiments of the present disclosure. As shown in FIG. 4, the driving method may comprise the following steps.

S101 in a reset phase, connecting, by the reset sub-circuit, the first node to the reference potential terminal under the control of the reset signal;

S102 in a compensation phase, writing, by the data signal writing sub-circuit, the data signal into the third node under the control of the first control signal; storing, by the compensation sub-circuit, a compensation voltage for the gate of the driving transistor in the driving sub-circuit under the control of the first control signal;

S103 in a light emitting phase, outputting, by the power input sub-circuit, the power signal to the second node under the control of the second control signal; bringing, by the driving sub-circuit, the second node into connection with the third node under the control of the compensation voltage; bringing, by the control sub-circuit, the third node into connection with the first node under the control of the second control signal.

An embodiment of the present disclosure provides a display panel comprising any of the above-described pixel circuits provided by the embodiments of the disclosure. The display panel may be applied to any product or component having a display function such as a mobile phone, a tablet computer, a television, a display, a notebook computer, a digital photo frame, a navigator, and the like. Since the principle of the display panel for solving the problem is similar to that of the pixel circuit, the implementation of the display panel may refer to the implementation of the pixel circuit described above, which will not be repeated herein.

Embodiments of the disclosure provide a pixel circuit, a driving method thereof, and a display panel. The pixel circuit comprises a reset sub-circuit, a compensation sub-circuit, a driving sub-circuit, a control sub-circuit, a data signal writing sub-circuit, a power input sub-circuit, and a light emitting device. The power input sub-circuit, the driving sub-circuit, the control sub-circuit, and the light emitting device are sequentially connected in series. The reset sub-circuit is connected in parallel with the light emitting device, and one terminal of the light emitting device is connected to the reference potential signal terminal. The reset sub-circuit is used for outputting the reference potential signal to the other terminal of the light emitting device under the control of the reset signal. The data signal writing sub-circuit can write the data signal into the third node between the driving sub-circuit and the control sub-circuit under the control of the first control signal. The compensation sub-circuit is connected to the first node between the light emitting device and the control sub-circuit, the second node between the power input sub-circuit and the driving sub-circuit, and the driving sub-circuit, and the compensation sub-circuit receives the first control signal. The compensation sub-circuit can store a compensation voltage for the gate of the driving transistor in the driving sub-circuit under the control of the first control signal, and the compensation voltage is substantially a sum of the voltage of the data signal and the threshold voltage of the driving transistor. The driving sub-circuit can bring the power input sub-circuit into connection with the control sub-circuit under the control of the compensation voltage provided by the compensation sub-circuit, and the control sub-circuit can bring the driving sub-circuit into connection with the light emitting device under the control of the second control signal at the same time, thereby driving the light emitting device to emit light.

With the above-described pixel circuits provided by the embodiments of the disclosure, the driving current for driving the light emitting device to emit light can be prevented from being affected by the threshold voltage of the driving transistor, which may mitigate the influence of the threshold voltage drift on the brightness of the light emitting device, so that the uniformity in brightness of the light emitting device can be improved, thereby enhancing the display quality of the display panel.

Those skilled in the art can make various modifications and variations to the present disclosure without departing from the spirit and scope thereof. In this way, if these modifications and variations to the disclosure pertain to the scope of the appended claims and equivalent technologies thereof, the present invention also intends to encompass these modifications and variations.

The invention claimed is:

1. A pixel circuit, comprising a reset sub-circuit, a compensation sub-circuit, a driving sub-circuit, a control sub-circuit, a data signal writing sub-circuit, a power input sub-circuit and a light emitting device, the power input sub-circuit, the driving sub-circuit, the control sub-circuit and the light emitting device being sequentially connected in series, one terminal of the light emitting device being connected to a reference potential terminal, the other terminal of the light emitting device being connected to the control sub-circuit through a first node, the reset sub-circuit being connected in parallel with the light emitting device, the driving sub-circuit comprising a driving transistor, wherein a first terminal of the reset sub-circuit is connected to the first node between the light emitting device and the control sub-circuit, a second terminal of the reset sub-circuit is connected to the reference potential terminal, a control terminal of the reset sub-circuit is capable of receiving a reset signal, and the reset sub-circuit is capable of outputting a reference potential signal of the reference potential terminal to the first node under control of the reset signal, wherein a first terminal of the compensation sub-circuit is connected to the first node, a second terminal thereof is connected to a second node between the power input sub-circuit and the driving sub-circuit, a third terminal thereof is connected to a gate of the driving transistor of the driving sub-circuit, a control terminal of the compensation sub-circuit is capable of receiving a first control signal, and the compensation sub-circuit is capable of storing a compensation voltage for the gate of the driving transistor of the driving sub-circuit under control of the first control signal, wherein the driving sub-circuit is connected to the control sub-circuit via a third node, and is capable of bringing the second node into connection with the third node under control of an output signal of the third terminal of the compensation sub-circuit, wherein a control terminal of the control sub-circuit is capable of receiving a second control signal, and the control sub-circuit is capable of bringing the third node into connection with the first node under control of the second control signal, wherein a control terminal of the data signal writing sub-circuit is capable of receiving the first control signal, a first terminal of the data signal writing sub-circuit is capable of receiving a data signal, a second terminal of the data signal writing sub-circuit is connected to the third node, and the data signal writing sub-circuit is capable of writing the data signal into the third node under control of the first control signal, wherein the power input sub-circuit is configured to receive a power signal and the second control signal, for outputting the power signal to the second node under control of the second control signal, and wherein the compensation sub-circuit comprises a fifth switching transistor and a capacitor, wherein a gate of the fifth switching transistor is capable of receiving the first control signal, a first terminal thereof is connected to the second node, a second terminal thereof is connected to one terminal of the capacitor and the gate of the driving transistor, respectively, and the other terminal of the capacitor is directly connected to the first node.

2. The pixel circuit according to claim 1, wherein a first terminal of the driving transistor is connected to the second node, and a second terminal thereof is connected to the third node.

3. The pixel circuit according to claim 1, wherein the power input sub-circuit comprises a second switching transistor, a gate of the second switching transistor being capable of receiving the second control signal, a first terminal thereof being capable of receiving the power signal, and a second terminal thereof being connected to the second node.

4. The pixel circuit according to claim 1, wherein the control sub-circuit comprises a third switching transistor, a gate of the third switching transistor being capable of receiving the second control signal, a first terminal thereof being connected to the third node, and a second terminal thereof being connected to the first node.

5. The pixel circuit according to claim 1, wherein the data signal writing sub-circuit comprises a fourth switching transistor, a gate of the fourth switching transistor capable of receiving the first control signal, a first terminal thereof being capable of inputting the data signal, and a second terminal thereof being connected to the third node.

6. The pixel circuit according to claim 1, wherein the reset sub-circuit comprises a sixth switching transistor, a gate of the sixth switching transistor being capable of receiving a reset signal, a first terminal thereof being connected to the reference potential terminal, and a second terminal thereof being connected to the first node.

7. The pixel circuit according to claim 1, wherein the compensation voltage is a sum of a data voltage and a threshold voltage of the driving transistor.

8. A driving method for the pixel circuit according to claim 1, comprising:

connecting, by the reset sub-circuit, the first node to the reference potential terminal under control of the reset signal;

writing, by the data signal writing sub-circuit, the data signal into the third node under control of the first control signal, and storing, by the compensation sub-circuit, the compensation voltage for the gate of the driving transistor of the driving sub-circuit under control of the first control signal;

outputting, by the power input sub-circuit, the power signal to the second node under control of the second control signal, bringing, by the driving sub-circuit, the second node into connection with the third node under control of the compensation voltage, and bringing, by the control sub-circuit, the third node into connection with the first node under control of the second control signal.

9. A display panel comprising the pixel circuit according to claim 1.

10. The display panel according to claim 9, wherein a first terminal of the driving transistor is connected to the second node, and a second terminal thereof is connected to the third node.

11. The display panel according to claim 9, wherein the power input sub-circuit comprises a second switching transistor, a gate of the second switching transistor being capable of receiving the second control signal, a first terminal thereof being capable of receiving the power signal, and a second terminal thereof being connected to the second node.

12. The display panel according to claim 9, wherein the control sub-circuit comprises a third switching transistor, a gate of the third switching transistor being capable of receiving the second control signal, a first terminal thereof being connected to the third node, and a second terminal thereof being connected to the first node.

13. The display panel according to claim 9, wherein the data signal writing sub-circuit comprises a fourth switching transistor, a gate of the fourth switching transistor being capable of receiving the first control signal, a first terminal thereof being capable of inputting the data signal, and a second terminal thereof being connected to the third node.

14. The display panel according to claim 9, wherein the reset sub-circuit comprises a sixth switching transistor, a gate of the sixth switching transistor being capable of receiving a reset signal, a first terminal thereof being connected to the reference potential terminal, and a second terminal thereof being connected to the first node.

15. The display panel according to claim 9, wherein the compensation voltage is a sum of a data voltage and a threshold voltage of the driving transistor.

16. A pixel circuit comprising a driving transistor, a second switching transistor, a third switching transistor, a fourth switching transistor, a fifth switching transistor, a sixth switching transistor, a capacitor, and a light emitting device, wherein a gate of the driving transistor is connected to one terminal of the capacitor and a second terminal of the fifth switching transistor, respectively, a first terminal of the driving transistor is connected to a second node, and a second terminal of the driving transistor is connected to a third node, a gate of the second switching transistor is capable of receiving a second control signal, a first terminal thereof is capable of receiving a power signal, and a second terminal thereof is connected to the second node, a gate of the third switching transistor is capable of receiving the second control signal, a first terminal thereof is connected to the third node, and a second terminal thereof is connected to a first node, a gate of the fourth switching transistor is capable of receiving a first control signal, a first terminal thereof is capable of receiving a data signal, and a second terminal thereof is connected to the third node, a gate of the fifth switching transistor is capable of receiving the first control signal, and a first terminal thereof is connected to the second node, the other terminal of the capacitor is directly connected to the first node, a gate of the sixth switching transistor is capable of receiving a reset signal, a first terminal thereof is connected to a reference potential signal terminal, and a second terminal thereof is connected to the first node, a first terminal of the light emitting device is connected to the first node, and a second terminal thereof is connected to the reference potential signal terminal.

17. The pixel circuit according to claim 16, wherein the driving transistor is an N-type transistor, and the second switching transistor, the third switching transistor, the fourth switching transistor, the fifth switching transistor, and the sixth switching transistor are all P-type transistors.

* * * * *